United States Patent [19]

Braddick

[11] Patent Number: 4,926,936

[45] Date of Patent: May 22, 1990

[54] MULTIPLE PURPOSE LINER HANGER CONSTRUCTION

[75] Inventor: Britt O. Braddick, Houston, Tex.

[73] Assignee: Texas Iron Works, Inc., Houston, Tex.

[21] Appl. No.: 382,195

[22] Filed: Jul. 20, 1989

[51] Int. Cl.[5] ..... E21B 23/00

[52] U.S. Cl. ..... 166/217; 166/102; 166/208; 166/216

[58] Field of Search ..... 166/216, 217, 208, 209, 166/210, 212, 240, 138, 139, 134, 102; 188/67; 285/144

[56] References Cited

U.S. PATENT DOCUMENTS

| | | | |
|---|---|---|---|
| 3,195,646 | 7/1965 | Brown | 166/216 |
| 3,999,605 | 12/1976 | Braddick | 166/212 |
| 4,440,223 | 4/1984 | Akkerman | 166/217 |
| 4,497,368 | 2/1985 | Baugh | 166/208 |
| 4,523,641 | 6/1985 | Manderscheid | 166/208 |
| 4,580,631 | 4/1986 | Baugh | 166/216 |
| 4,688,642 | 8/1987 | Baker | 166/216 |
| 4,732,212 | 3/1988 | Fraser, III | 166/216 |
| 4,762,177 | 8/1988 | Smith, Jr. | 166/216 |
| 4,834,185 | 5/1989 | Braddick | 166/208 |

OTHER PUBLICATIONS

Texas Iron Works, Inc. Catalog, p. 7027.

*Primary Examiner*—Bruce M. Kisliuk
*Attorney, Agent, or Firm*—Jack W. Hayden

[57] ABSTRACT

A mechanical or hydraulic actuated liner hanger for supporting on an operating string to be lowered to position a liner on a tubular member in a well bore includes an integral tubular body having upper and lower annular rings thereon. A surface is provided on each ring to enable upper and lower cone segments to be positioned on each upper and lower ring, respectively, and a surface is provided on each ring that cooperates with a surface on the cone segments interlocks and retains the cone segments removably on their respective ring. A securing device may removably secure the cone segments in position on each ring. A sleeve is slidably supported on the body by lugs on the body and a recess arrangement. The sleeve includes upper and lower slip arms secured at one end on the sleeve and extending therefrom with upper and lower slip segments secured on the end of each the upper and lower slip arms. When relative longitudinal movement between the sleeve and longitudinal body is effected, the slip segments engage with the cone segments on each the upper and lower rows for movement outwardly into engagement with the tubular member to position the liner in the well bore.

The same body may be employed with the hydraulic or mechanically actuated hanger. The same sleeve, lug and recess arrangement may be employed with either a mechanical left-hand set or right-hand set rotatable liner hanger.

29 Claims, 4 Drawing Sheets

FIG. 1
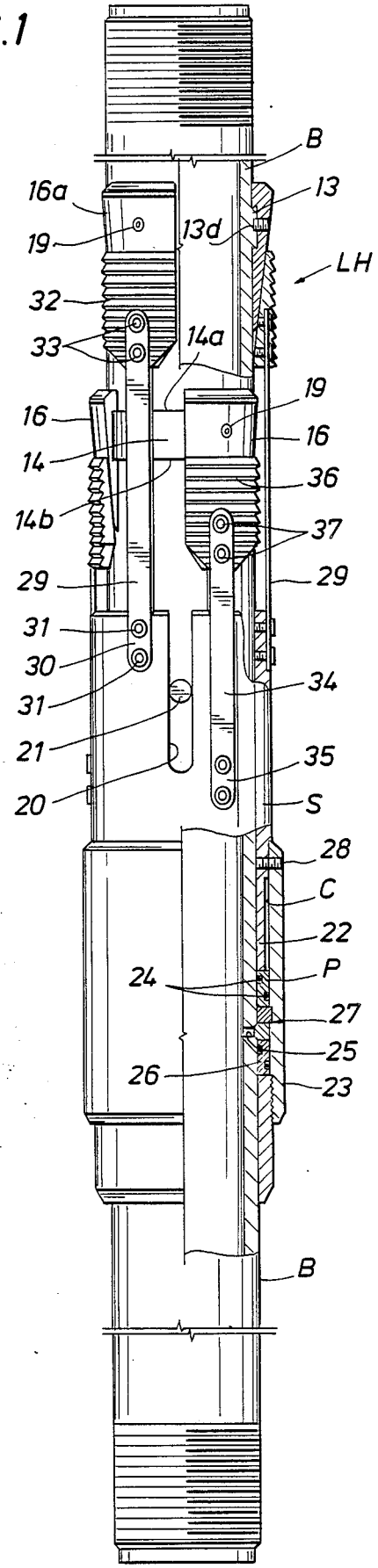
FIG. 2
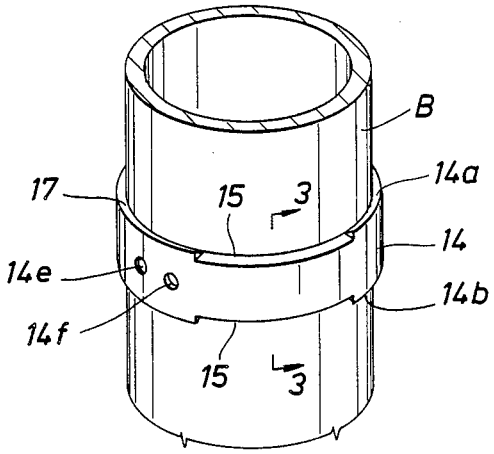
FIG. 3
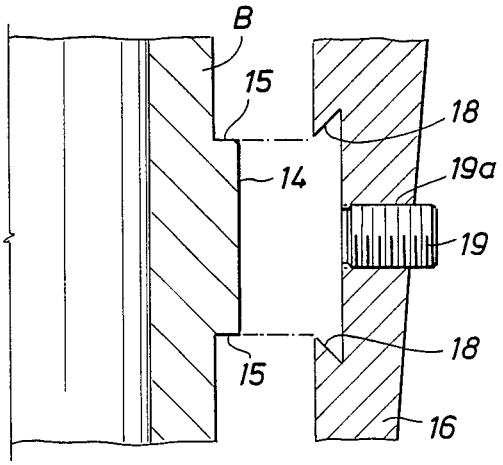
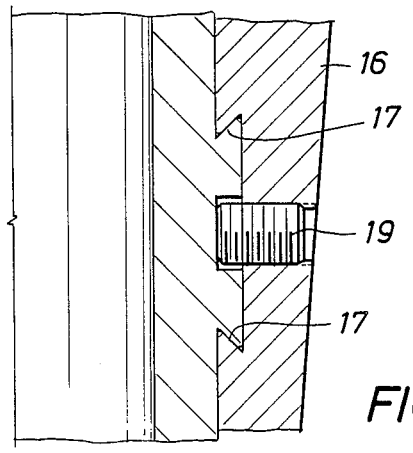
FIG. 4

MULTIPLE PURPOSE LINER HANGER CONSTRUCTION

SUMMARY OF THE INVENTION

The use of liner hangers for securing a liner in position on a tubular member in a well bore is well known. An operating string is releasably connected with a liner having a liner hanger thereon whereby the liner may be lowered into the well bore by the operating string and positioned or hung by the liner hanger within a tubular member such as a casing in the well bore.

It can be appreciated that various size liners and various size tubular members are employed in a well bore. In each size tubular member, there are a plurality of weights which vary the wall thickness of the tubular member thus varying the inner diameter of each pipe of a predetermined outer diameter. The inner diameter of a tubular member may effect the length of the taper and size of the cone and slip segments employed with the hanger so as to assure that the hanger slip and cone segments cooperate properly to engage the slip segments with the tubular member and position or secure the liner therewith.

Heretofore, it has been common practice to provide hydraulic and mechanically actuated liner hangers for each pipe size and pipe weight in that pipe size which requires a substantial inventory of liner hangers to assure that various customers needs, depending upon the type of liner hanger and size tubular member in the well bore in which the hanger is to be hung, may be met. The inventory is further complicated in that mechanical hangers may be either right-hand set or left-handed set and thus it has been necessary to have an inventory of each type of mechanical hanger for each pipe size as well as for the multiple pipe weights in each size.

The present invention overcomes this problem and provides a liner hanger having a body and a cage or sleeve thereon that is employed in either a hydraulic or a mechanical set liner so that the same body and sleeve is employed in each respective type liner hanger in all size pipe and all weights of pipe within each size. The cone segments and slip segments are replaceably supported on the body so that the proper cone segment and its corresponding slip segment may be positioned on the body and replaced readily if necessary depending on the pipe size and weight in which the hanger is to be employed. This greatly reduces the cost of manufacturing and the amount of inventory of hangers that must be maintained, since the same body and same sleeve may be used with any size pipe and any weight pipe. The same hanger body is employed for mechanical right-hand set and left-hand set as well as hydraulic set hangers. Where the hanger is left-hand set for use with the same pipe size and weight it is only necessary to reposition the lower cone segments on the lower ring on the body and to switch the position of the upper and lower slip arms and segments thereon on the sleeve on the body of the hanger. This assures that there is proper circumferential clearance between the longitudinal edges of the lower cone segments and the adjacent edges of the upper slip arms to effect proper alignment between the upper slip arms that support the upper slip segments and the upper cones and proper alignment of the lower cones with the lower slip segments and also so that there will be no interference between the upper slip arms and lower cone segments as the body is rotated by the operating string to align the upper and lower slip segments with their respective co-engageable upper and lower cone segments. Where the liner hanger is to be left-hand set, the above steps would be reversed to place the components in the relation shown in FIG. 8.

One or the primary objects of the present invention is to provide a simplified, all purpose hanger body that can be employed with a hydraulically actuated or a mechanically actuated hanger arrangement.

Yet a further object of the present invention is to provide a simplified liner hanger arrangement that can be employed with any size and weight pipe with a minimum of change, thus eliminating the necessity of maintaining a plurality of various size liner hangers in inventory to accommodate the multiple size pipe and multiple weights in each size of pipe that is used in setting a liner in a well bore.

Other objects and advantages of the present invention will become more readily apparent from a consideration of the following description and drawings.

BRIEF DESCRIPTION OF THE DRAWINGS

FIG. 1 is a longitudinal perspective view partly in section of a hydraulic set hanger that illustrates a form of the body and sleeve arrangement of the present invention;

FIG. 2 is a partial elevational view of the lower ring on the body and one arrangement of the surface means and additional surface means on the upper and lower rings which enables the slip segments to be positioned thereon and to be retained thereon, as well as the socket means for receiving securing means such as a screw to secure the cone segments in circumferential position on the ring;

FIG. 3 is a sectional view on the line 3—3 of FIG. 2 illustrating in greater detail the surface means on the rings which enable the cone segment to be initially positioned thereon;

FIG. 4 is a sectional view showing a lower cone segment moved circumferentially from the position of FIG. 3 on the ring and a form of the surface means on the slip segment that engages and interlocks with additional surface means on the cone segment. A securing device such as an Allen screw is shown for removably retaining the cone segment in circumferential position on each ring;

DESCRIPTION OF THE PREFERRED EMBODIMENTS

Figure 5:
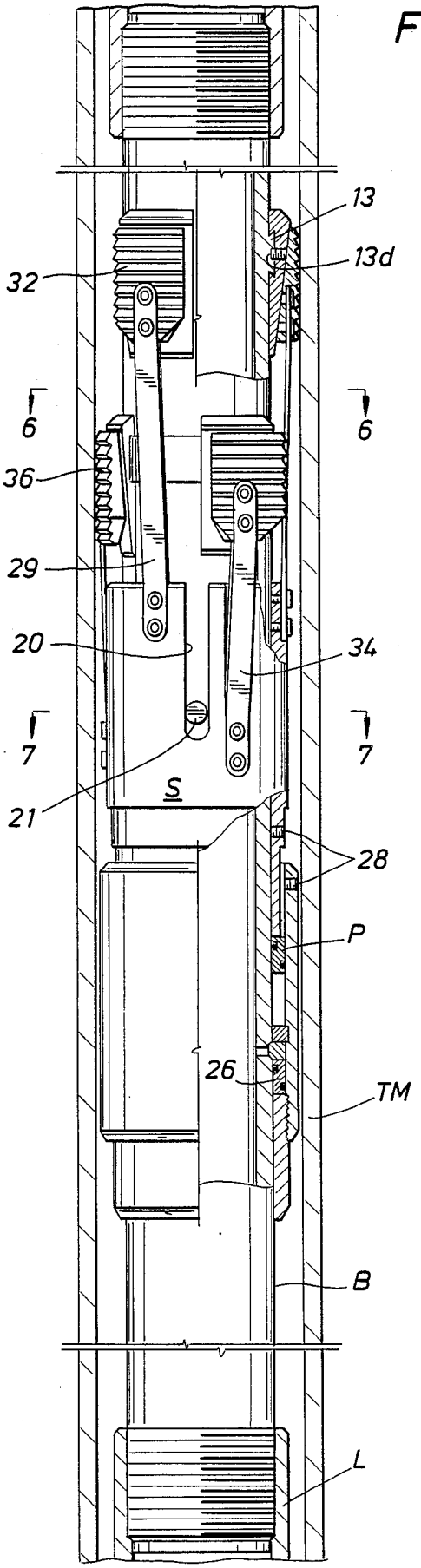
FIG. 5 is a longitudinal sectional view illustrating the arrangement of FIG. 1 actuated with the slips engaging a tubular member to secure a liner in a well bore.
Figure 6:
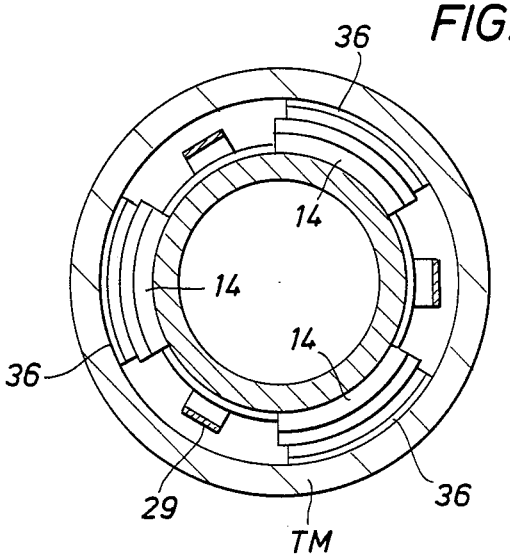
FIG. 6 is a sectional view on the line 6—6 of FIG. 5 illustrating further structural details.
Figure 7:
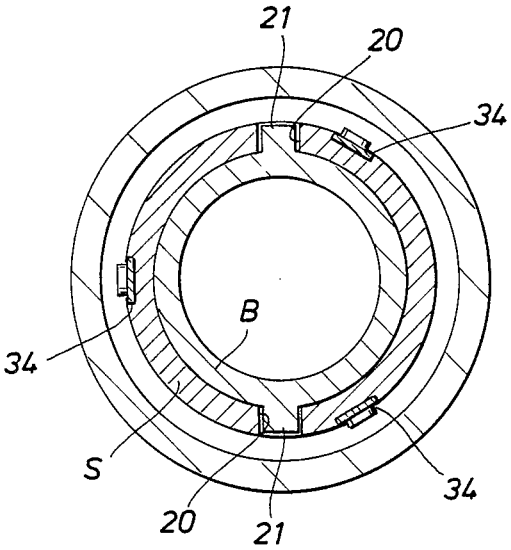
FIG. 7 is a sectional view on the line 7—7 of FIG. 5 illustrating further structural details.

Attention is first directed to FIG. 1 wherein a hydraulic actuated liner hanger of the present invention is shown and referred to generally by the letters LH. The liner hanger LH includes a tubular integral body designated by the letter B having threads at the lower end for connecting with a liner L as shown in FIG. 5. The body B is provided with an upper annular ring 13 and a lower annular ring 14 longitudinally spaced therebelow. FIG. 2 illustrates a portion of the integral body B adjacent the location of the lower ring 14. Each ring 13 and 14 includes an annular upper and lower edge surface 14*a*, 14*b*, respectively, which annular upper and lower edge surfaces are cut radially as shown as 15 in FIG. 3 a suitable circumferential extent that is slightly larger than the circumferential extent of the lower cone segments 16 and upper cone segments 16*a* to be positioned on the lower ring 14 and upper ring 13, respectively. The upper ring 13 and lower ring 14 are each provided with the flat or radial and circumferentially extending surface 15 for initially receiving the upper and lower cone segments thereon respectively. Each the upper and lower rings 13 and 14 include additional surface means 17 which are configured to engage with a surface 18 on each the upper and lower cone segments which is configured to interlock with the surface 17 on each upper and lower ring 13 and 14 when the cone segments are moved circumferentially relative to surface 15. It can be appreciated that if desired only one edge of each ring may be provided with the surface 15 at the section line 3—3 in the drawings. The segments may be moved on each ring circumferentially to a desired location, and normally three segments are employed on each ring and thus are spaced at 120° from center line to center line on each the upper and lower ring 13 and 14, and the upper and lower cone segments 16*a*, 16, respectively, are offset circumferentially as shown. Suitable securing means such as an Allen screws 19 or the like may be employed for securing or locking each upper and lower cone segment in circumferential position on the upper and lower rings 13 and 14.

Figure 8:
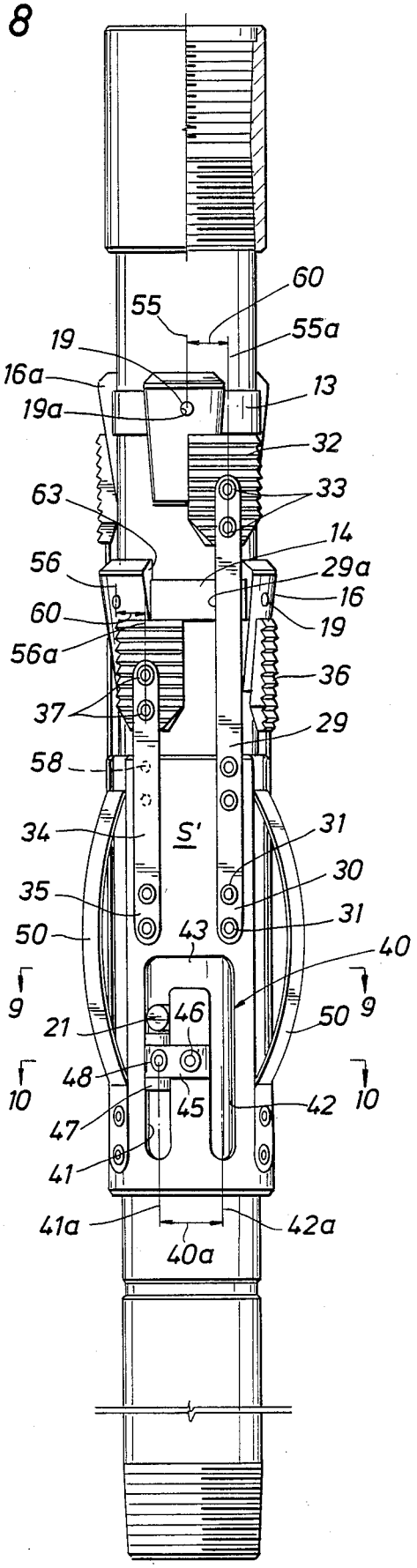
FIG. 8 illustrates the present invention employed with a mechanically actuated left-hand set liner hanger.

The upper ring 13 has recesses 13*d* spaced at equidistant positions about the ring 13 to provide a socket to receive the Allen screw 19 therein to secure each upper cone segment. The lower ring 14 has six circumferentially spaced sockets, or recesses as represented at 14*e*, 14*f* in FIG. 2. Where a mechanical set hanger is to be used, and assuming that the body B, sleeve S', and slip and cone segments are positioned as shown in FIG. 8 for left-hand rotation of the operating string and body B to set the liner hanger LH in the tubular member, then the lower cone segments 16 will be secured equidistant apart circumferentially on ring 14 in sockets 14*f* as represented in FIGS. 2 and 4.

When the mechanical set form of liner hanger is to be used as a right-hand set liner hanger, the cone segments 16 are moved circumferentially from their position in recesses 14*f* of ring 14 circumferentially to be positioned by securing Allen screws in recess 14*e*. The Allen screw 19 that secure each the upper and lower cone segments 16*a*, 16 on upper and lower rings 13 and 14 are in threaded holes 19*a* of each upper and lower cone segments 16*a*, 16 so that the center lines of the holes are on the center line longitudinal axis of each segment. Holes 19*a* in cones can be offset any distance off the center line provided sockets 14*e* and 14*f* are offset on rings 13 and 14 by a corresponding amount.

It can be appreciated that the recesses 14*e* are also equidistant spaced on lower ring 14 and that the recesses 14*f* are equidistant spaced on the ring 14 from center line to center line.

Figure 12:
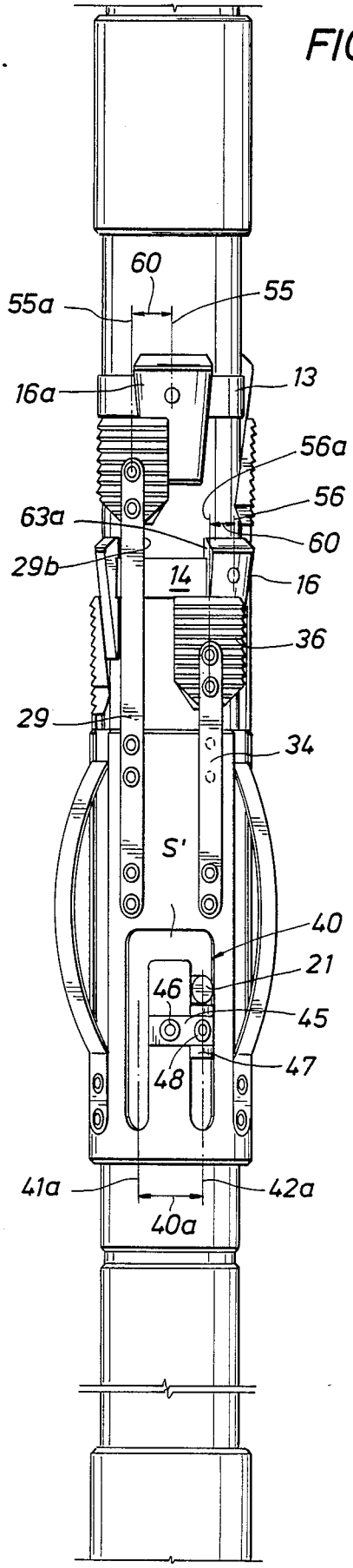
FIG. 12 illustrates the arrangement of the components in unset position of a right-hand mechanical set liner hanger is to be employed.

The additional recesses 14*f* in ring 14 are necessary to provide the proper angular spacing between the longitudinal edge 63*a* of the repositioned lower cone segments on the lower ring 14 and the adjacent longitudinal edges 29*b* of the repositioned upper slip arms 29 towards which each lower cone segment is moved to the left, or clockwise (as viewed in elevation in FIG. 12) as the operating string and body B connected therewith are rotated to the left in a clockwise direction as viewed in elevation in FIG. 12. The critical angular relationships between the longitudinal edge 63*a* of each repositioned lower cone segment and adjacent edge 29*b* of each upper slip arm toward which they are moved is shown in FIG. 12 and explained in greater detail herein. Also the relationship between the above described angular relationship and the angular relationship of the longitudinal center lines of slots 41, 42 of the U-slot 40 is explained hereinafter. When changing from left-hand set to right-hand set or from right-hand set to left-hand mechanical set, the cone segments 16*a* in the upper ring 13 remain in the same position on ring 13.

In the hydraulic form of FIGS. 1 and 5, a sleeve S is mounted on the integral body B and includes recess means comprising at least one longitudinally extending recess 20, and preferably two recess which are diametrically opposed and lugs 21 mounted on the body B and projecting therefrom to slidably fit within the recesses 20. This serves as a means to maintain the upper and lower slip arms and upper and lower cone segments aligned, to guide the upper and lower slip arms and their slips onto their respective co-engageable slip segments, and to limit upward movement of sleeve S and piston P to maintain pressure integrity of chamber C.

The lower end 22 of the sleeve S extends into the chamber C formed on the body B and by any suitable means such as the annular member 23 which may be positioned on the body B in any desired manner to radially space it therefrom to form the chamber C. A piston P having suitable seal means 24 thereon is positioned in the chamber as shown. Port means 25 are provided in the body for communicating with the operating string and bore of the body B. The body B and hanger supported therewith may be lowered into the well bore to position the liner in and secure it with the well string tubular member TM as illustrated in FIG. 5. A seal ring 26 is retained in position at the other end of chamber C by the split ring in the groove in chamber C, split ring 27 in a groove in the body and the threaded connected between annular member 23 and the body.

The port 25 in the body communicates fluid pressure from the operating string to the chamber C to move the piston P and lower end 22 of sleeve S upwardly and outwardly of the chamber. Suitable means prevent premature actuation of the sleeve means S such means taking any suitable form such as the frangible pin or shear pin 28.

Longitudinally extending upper slip segment arms 29 are releasably mounted on the sleeve S as shown in the drawings. Where three upper cone segments are mounted on the upper ring, there will be provided three upper slip arms 29 equally spaced about the sleeve 13. The lower end 30 of each slip arm 29 is removably secured by any suitable means such as Allen screws 31 or the like to the sleeve as shown so that the upper slip arms extend longitudinally therefrom. The upper slip segments 32 are removably secured to each respective slip arm by any suitable means such as the Allen screws 33 as shown. Lower slip arms 34 are secured at one end 35 to the sleeve S and extend longitudinally therefrom and a lower slip segment 36 is secured at the other end of each lower slip arm 35 by any suitable removable means such as the Allen screws 37. The number of upper and lower slips 32 and 36 and upper and lower slip arms 29, 34, respectively, corresponds with the number of upper and lower cone segments **16*a*, 16 supported on the upper and lower rings 13, 14**.

FIG. 5 illustrates the hydraulic liner hanger embodiment of FIG. 1 as having been actuated so that shear pin 28 has been sheared and the respective upper and lower row of slip segments 32, 36 have been moved upwardly by the movement of the upper and lower slip arms 29, 34, respectively along with sleeve S and piston P to engage each upper and lower slip segment with their respectively aligned cone segments **16*a*, 16 on the upper and lower rings 13 and 14** so that the slip segments are moved outwardly to engage the interior of the well string tubular member TM and secure the liner L in position thereon. After the liner L is hung in the well bore and when it is desired to release the operating string and retrieve it from the well bore, suitable means and method well known in the art are employed for this purpose.

Whereas FIG. 1 illustrates the means for effecting relative longitudinal movement between the sleeve S and the body B as being hydraulically actuated, FIGS. 8–12 illustrate the present invention where it may be mechanically actuated by manipulation of the operating string including rotation thereof to effect rotation of the body B to align the respective upper and lower rows of cone segments with the upper and lower rows of slip segments whereupon lowering the operating string relative to sleeve S′ engages the upper and lower slip segments with the upper and lower cone segments, respectively.

Whether the invention employs the hydraulic form or the mechanical form as a means for effecting relative longitudinal movement, each form employs the same integral body with an upper and lower ring 13, 14 thereon for receiving circumferentially spaced cone segments. The sleeve on the body for the hydraulic form differs slightly for the mechanical set liner hanger. Specifically the sleeve S′ of the mechanical form accommodates either right or left-hand setting of the liner hanger. Upon relative rotational movement between the sleeve S′ and the body B, upper and lower slip segments 32, 36 supported on the sleeve S′ by means of the upper and lower slip 29, 34 arms are positioned, so that the operating string, when lowered, engages the respective upper and lower cone segments **16*a*, 16 with upper and lower slip segments 32, 36** and move them outwardly to engage the interior wall of the tubular member and secure the liner L in position therein.

Regardless of which mechanical form of the invention is employed, that is right-hand rotational set or left-hand rotational set, where the tubular member inner diameter changes due to a change in weight per foot of pipe length or pipe size, the same integral body B and sleeve S′ may be employed and the only components in each form of the disclosed invention that may need to be substituted are the cone segments in the upper and lower rings and the slip segments supported on the upper and lower slip arms 29 and 34, depending upon whether or not the pipe weight and pipe size is changed. The only changes to go from a left-hand rotational set to a right-hand rotational set hanger or from a right-hand rotational set to a left-hand rotational set hanger are to reverse the position of the upper slip arms with the position of the lower slip arms, and the lower cone segments 16 are shifted between holes **14*e*, 14*f* on lower ring 14 to provide adequate angular clearance for relative rotational movement of the lower cone segments 16** on body B relative to the longitudinal edge of an adjacent repositioned upper arm. This substantially reduces the inventory and cost involved in maintaining a supply of liner hangers to meet the customer requirements for either hydraulic or mechanical set liner hangers in any pipe size and pipe weight within any pipe size that the customer may require.

Figure 9:
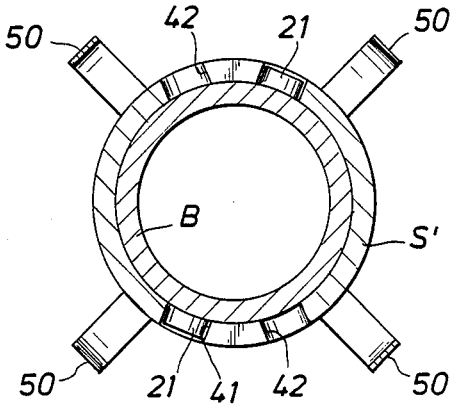
FIG. 9 is a sectional view on the line 9—9 of FIG. 8.
Figure 10:
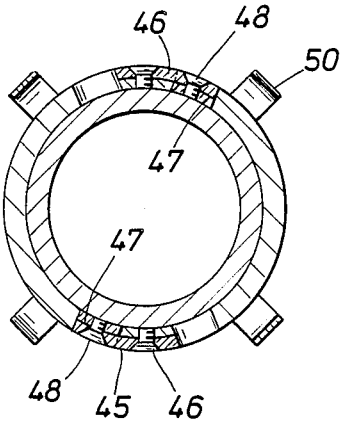
FIG. 10 is a sectional view on the line 10—10 of FIG. 8.

In FIG. 8 a left-hand rotational set embodiment of the mechanical set form is illustrated wherein the relative movement between the sleeve S′ supported on the body B is effected by manipulation of the operating string connected with the body B in a manner well known in the art. In the mechanical embodiment, the means to align the upper and lower slip segments 32 and 36 with the upper and lower cone segments **16*a* and 16 on the upper and lower rings 13 and 14 includes recess means in the form of at least one inverted U shaped recess referred to generally by the numeral 40. Preferably, two inverted U shaped recesses, diametrically opposed, are employed. The recess 40 includes first and second parallel, longitudinally extending circumferential spaced setting slots 41 and 42 which are joined adjacent their upper ends by the slotted portion 43 to form the inverted U shaped slot. A block 45 is removably secured to the sleeve S′ between slots 41, 42 by any suitable means such as Allen screw 46. The block 45 has a member 47 secured to block 45 by Allen screws 48 so that member 47 can be positioned in either one of the longitudinally extending setting slots 41 or 42. In the embodiment illustrated in FIG. 8, the member 47 is shown as being positioned in the slot 41 and when in this position, the liner hanger LH is left-hand rotational set. That is, the operating string and body are manipulated to move lug 21 into slot 42 as will be explained. Immediately above and in contact with the upper end of the member 47 supported on the block 46 is the lug 21 that is positioned in groove 41. Another lug 21 is positioned in groove 41 in opposed relation on sleeve S′ as shown in FIG. 9. The sleeve means S′ is provided with bow springs 50 spaced circumferential about the sleeve means S′ as better illustrated in FIG. 9** which cooperate to restrain the sleeve S′ as the operating string and body B are moved relative thereto.

As the mechanical form of liner hanger illustrated in FIGS. 8 and 12 is lowered into the well bore the lugs 21 on the body B engage the upper end of the member 47 and retain the sleeve S′ in the position shown in FIGS. 8 and 12 so that the upper and lower slip segments 32, 36 are in non-active relation relative to the upper and lower cone segments **16*a* and 16 on the upper and lower rings 13 and 14**.

As viewed in the FIG. 8 embodiment, the center longitudinal axis of each upper and lower cone segment represented by the line 55 and 56 respectively, is circumferential offset in a clockwise direction or to the left from the center longitudinal axis of each respective co-engageable upper and lower slip segment 32, 36 represented by the lines 55a, 56a by a circumferential angular arc distance represented at 60 which is approximately equal to the circumferential angular arc distance between the center lines of the setting slots 41, 42. The center longitudinal lines of these slots are represented at 41a, 42a, respectively, and the circumferential angular arc therebetween is represented at 40a. Similarly, the center longitudinal axis of each upper and lower slip segment represented by the lines 55a, 56a must be circumferentially offset in a counterclockwise direction, or to the right from the center longitudinal axis represented by the lines 55, 56 of each respective co-engageable upper and lower cone segment by a circumferential angular arc distance represented at 60 which is approximately equal to the circumferential angular arc distance represented at 40a between the center lines 41a, 42a of the setting slots 41, 42.

When the mechanical left-hand set liner hanger as shown in FIG. 8 or the right-hand mechanically set hanger shown in FIG. 12 is assembled and ready for running or lowering into the well bore, each upper and lower cone segment 16a and 16 is circumferentially offset from its respective co-engageable upper and lower slip segments 32 and 36 by a circumferential angular arc distance represented by the numeral 40a between the center lines 41a, 42a of the setting slots 41, 42.

Figure 11:
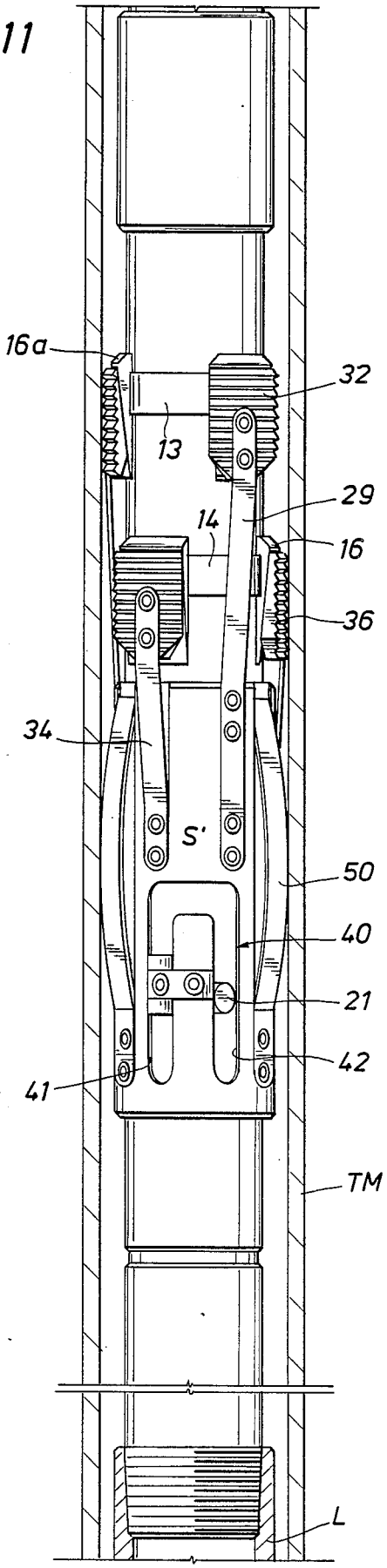
FIG. 11 illustrates the form of the liner hanger shown in FIG. 8 actuated and the slip segments engaged with a tubular member in the well bore.

The above arrangement insures that when the mechanical liner hanger is actuated, that is when body B is lifted so as to move the lugs 21 up out of slots 41 of the FIG. 8 embodiment and align them with transverse slot portion 43 for movement therethrough as the body B is rotated left-hand or counterclockwise to the right as viewed in FIG. 8, the lugs 21 align with the slots 42 and this aligns the upper cone segments 16a, with the upper slip arms 29, and the upper slip segments 32 supported thereon as shown in FIG. 11. It also assures that there is sufficient circumferential clearance between the longitudinal edge of the lower cone segments and the longitudinal edge 29a of each adjacent upper arm 29 to effect such alignment as well as aligning the lower slip arms and slips with the lower cone segments. When lugs 21 are aligned with slot 42 the body B can be lowered relative to the sleeve S' since lugs 21 can move down slot 42 because the bow springs 50 will engage the tubular member TM and restrain longitudinal movement of the sleeve S' to the body. The bow springs 50 also restrain sleeve S' when body B is rotated to move aligned lugs 21 through transverse slot 43. Alignment of the lugs 21 with slot 42 also aligns the upper slip segments 32 with the upper cone segments 16a on the upper ring 13 and also aligns the lower slip segments 36 with the cone segments 16 on ring 14 so that as the body is lowered the slip segments will be moved outwardly to engage the tubular member as illustrated in FIG. 11 to thereby position and secure the liner L in the tubular member TM. FIG. 11 illustrates this position and shows the relative position of the components of a left-hand rotational set, or left-hand, or counterclockwise, rotatable body mechanical liner hanger after it has been actuated from the left to the right as viewed in FIG. 11 to engage the upper and lower slip segments 32, 36 on their respective upper and lower cone segments 16a and 16 on the upper and lower rings 13 and 14.

Where a left-hand mechanical liner hanger is employed as shown in FIG. 8, the center longitudinal axis 55, 56 of each upper and lower cone segment 16a, 16 must be circumferentially offset in a clockwise direction that is, to the left as viewed in FIG. 8, from the center longitudinal axis 55a, 56a of each respective co-engageable upper and lower slip segment 32 36 by a circumferential angular arc distance represented at 60 approximately equal to the angular arc distance represented at 40a between the center lines 41a, 42a of the setting slots 41, 42 as previously described.

Further, the center longitudinal axis of each upper and lower slip segment 32, 36 is circumferentially offset in a counterclockwise direction, that is to the right as view in FIG. 8, from the center longitudinal axis of each respective co-engageable upper and lower cone segment 16a, 16 by a circumferential angular arc distance represented at 60 approximately equal to the circumferential angular arc distance represented at 40a between the longitudinal center lines of the setting slots 41, 42 which is not greater than the circumferential angular arc distance between the longitudinal edge of any lower cone segment, such as the edge represented at 63 in FIG. 8 and the adjacent longitudinal edge as represented at 29a of any upper slip arm 29 toward which said lower cone segment 56 is rotated along with said body B in order to align respective upper and lower cone segments 16a, 16 with their co-engageable upper and lower slip segments 32, 36.

Where the present invention is to be employed as a right-hand rotational set hanger, the components will be assembled as shown in FIG. 12. It is only necessary to shift the block 45 and member 47 from groove 41 of U slots 40 to slot 42 by releasing the securing screws and positioning the block 45 and member 47 to fit in the groove 42. Also, it is necessary to exchange the positions of the longer upper slip arms 29 and the slips supported thereon with the lower and shorter slip arms 34 and the slips supported thereon. Threaded openings are provided in sleeve S' as represented in dotted line at 58 to enable the upper slip arms 29 to be positioned by screws 31 where lower slip arms 34 are shown as positioned in the FIG. 8 form. The shorter lower slip 34 arms are then positioned where upper slip arms 29 are shown in FIG. 8. Also, lower cone segments 16 are shifted clockwise, or to the left as viewed in FIG. 2, from recesses 14f to recesses 14e. This is necessary so that when the body B is rotated clockwise, or from right to left as viewed in elevation in FIG. 12, relative to sleeve S', there will be sufficient circumferential clearance between the longitudinal edge 29b of adjacent upper slip arm 29 and the longitudinal edge 63a of the lower cone segments 16 which are moved towards the adjacent longitudinal edge 29b of each upper slip arm as can be seen in FIG. 12 to align the upper and lower cone segments 16a, 16 with their respective upper and lower co-engageable slip segments 32, 36 without interference between the upper slip arms and lower cone segments.

The mechanical set liner hanger as illustrated in FIG. 12 is right-hand rotational set, that is the body B is rotated clockwise when viewed from its upper end, or that is from the right to the left as viewed in elevation in FIG. 12 and the center longitudinal axis 55, 56 of each upper and lower cone segment 16a, 16 is circumferentially offset to the right or in a counterclockwise direction, as viewed in FIG. 12, from the center longitudinal axis 55a, 56a of each respective co-engageable upper and lower slip segment 32, 36 by an angular distance represented at 60 approximately equal to the circumferential angular arc distance represented at 40a between the center lines 41a, 42a of the setting slots 41, 42. The circumferential angular arc distance between the center lines 41a, 42a of the slots 41, 42 must not be greater than the circumferential angular arc distance between the longitudinal edge 63a of each lower cone segment 16 and the adjacent longitudinal edge 29b of each upper slip arm 29 toward which any said lower cone segment 16 is rotated as body B is rotated in order to align respective upper and lower cone segments with their co-engageable upper and lower slip segments to set the liner hanger.

Whether a mechanical left-hand rotational or a mechanical right-hand rotational form of the invention is employed, the angular arc distance 40a between the center lines of the setting slots 41 and 42 must not be greater than the circumferential angular arc distance between the longitudinal edge of any lower cone segment and the adjacent longitudinal edge of any upper slip arm towards which said lower cone segment is rotated in order to align respective upper and lower cone segments with their co-engageable upper and lower slip segments. This angle between the longitudinal edge 63 of the lower cone segments and the edge 29a of the upper arms is readily seen in FIG. 8 and the angle between the longitudinal edge 63a of the lower cone segments and the edge 29b of the upper arm is readily seen in FIG. 12. Further in a running position both the left-hand rotational and right-hand rotational mechanical liner hanger upper and lower segments must be circumferentially offset from their respective co-engageable upper and lower slip segments by an angular arc distance approximately equal to the angular arc distance between the center lines of the setting slots.

As previously noted where the inner diameter of the tubular member in which the hanger is to be employed changes due to a change in the weight of the pipe, or where the pipe size changes, it may be necessary when either the mechanical or hydraulic form is employed to substitute upper and lower slip segments and upper and lower cone segments of a different size which will change the length of the taper on the slip segments and cone segments. The manner of determining whether or not such change is needed is well known to those skilled in the art and is not part of the present invention. Other than changing the position of the member 47 in setting slots 41, 42 and changing the position of the upper and lower slip arms, there is nothing else involved that is required so that the present invention can be readily employed in either a mechanical left-hand set or mechanical right-hand set liner hanger where the hanger is to run same size and weight of pipe. If the pipe size or weight changes, it may also be necessary to change the size and taper of the upper and lower cone segments and slip segments. The lugs 21 and recess arrangement 40 provides a means to retain and means to align the sleeve and body in a predetermined manner.

While it is believed that the operation is apparent from the foregoing, where a left-hand set mechanical liner is employed, the component arrangement is as shown in FIG. 8, when the liner hanger is run into the well bore in unset position. The arrangement of the slot means 40, circular block 45 and member 47 provides a left-hand J-slot. When the operating string is lifted, bow springs 50 restrain sleeve S' and the lug 21 moves with body B up slot 41 to align with slot 43. The operating string and body B are left-hand rotated, or from the left to the right as viewed in elevation in FIG. 8, or counterclockwise if body B is viewed looking down on its upper end in FIG. 8 to align lug 21 with slot 42, and bow springs 50 again restrain sleeve S' relative to the rotating body. This aligns upper and lower cone segments with the upper and lower slip segments. When the lugs 21 on the body B are aligned with slots 42, the operating string and body B are lowered so that the aligned cone segments receive their respective co-engageable slip segments and urge the slip segments outwardly to engage tubular member TM and hang liner L therein. Bow springs 50 again restrain the sleeve S' during such lowering of the operating string and body.

The operating string is released from the hanger by means and method well known in the art and returned to the earth's surface.

Where it is desired to employ a right-hand rotational set hanger, the block 45 and member 47 are changed to slot 42 as shown in FIG. 12 to provide a right-hand J-slot. The position of upper arms 29 and their slips are exchanged with lower arm slips 34 as can be seen by comparing FIG. 12 with FIG. 8. The cone segments in lower cone 14 are moved to the left by removing them from opening 14f as shown in FIG. 2 to position them in openings 14e so that when the body B is rotated by the operating string from the right to the left, that is clockwise as viewed in elevation in FIG. 12, there is proper angular clearance for lower cone segments to move with body B without edge 63a engaging the longitudinal edge 29b of the adjacent upper arm 29 towards which they are moved. The operation of the right-hand set of FIG. 12 is by manipulating the operating string and body B to move lug 21 from slot 42 to slot 41 to align the upper cones and repositioned lower cones with the repositioned upper and lower slip arms and their slips to set the liner hanger and liner in tubular member.

The foregoing disclosure and description of the invention are illustrative and explanatory thereof, and various changes in size, shape and materials as well as in the details of the illustrated construction may be made without departing from the spirit of the invention.

What is claimed is:

1. In a liner hanger which may be actuated hydraulically or mechanically for supporting a liner lowered on an operating string to position in a tubular member in a well bore including:

a longitudinally extending tubular body;

upper and lower longitudinally spaced annular rings on said body;

upper and lower cone segments for removably fitting on said upper and lower rings;

said upper and lower cone segments having longitudinally extending edges;

surface means on each of said upper and lower rings to enable said upper and lower cone segments to be removably positioned thereon;

additional surface means on each of said upper and lower rings;

surface means on each said upper and lower cone segments engageable with said surface means and additional surface means on said upper and lower rings to removably retain said upper and lower cone segments on each of said upper and lower rings, respectively; and means to removably secure said upper and lower cone segments in predetermined positions on each of said upper and lower rings, respectively.

2. The liner hanger of claim 1 including:

an annular sleeve on said body longitudinally spaced from said rings;

longitudinally extending upper slip arms removably secured with said sleeve, said upper slip arms having one end extending longitudinally beyond said sleeve toward said upper ring;

longitudinally extending lower slip arms removably secured with said sleeve, said lower slip arms having one end extending longitudinally beyond said sleeve toward said lower ring;

upper slip segments secured to said one end of said upper slip arms and co-engageable with said upper cone segments on said upper ring for engaging said upper slip segments with the tubular member to secure the liner with the tubular member;

lower slip segments secured to said one end of said lower slip arms and co-engageable with said lower cone segments on said lower ring for engaging said lower slip segments with the tubular member to secure the liner with the tubular member;

means for effecting relative movement between said body and said sleeve, upper and lower slip arms and their upper and lower respective slip segments longitudinally relative to said body to engage an upper slip segment with an upper cone segment and a lower slip segment with a lower cone segment whereby said upper and lower slip segments are urged outwardly of said body to engage the tubular member;

means to align said upper and lower slip segments and upper and lower cone segments, respectively, for engagement, said means including:

at least one lug on said body and projecting therefrom; and recess means on said sleeve for receiving said lug therein to align said upper and lower slip segments with said upper and lower cone segments, respectively, for co-engagement when said sleeve is moved longitudinally relative to said body.

3. The liner hanger of claim 2 including means to releasably restrain said sleeve against longitudinal movement which would co-engage said upper and lower slip segments with their respective upper and lower cone segments and urge said upper and lower slip segments outwardly and into engagement with the tubular member as the liner hanger is being lowered to position in the well bore.

4. In a liner hanger which may be actuated hydraulically for supporting a liner lowered on an operating string to position in a tubular member in a well bore including:

a longitudinally extending tubular body;

upper and lower longitudinally spaced annular rings on said body;

upper and lower cone segments for removably fitting on said upper and lower rings;

said upper and lower cone segments having longitudinally extending edges;

surface means on each of said upper and lower rings to enable said upper and lower cone segments to be removably positioned thereon;

additional surface means on each of said upper and lower rings;

surface means on each said upper and lower cone segments engageable with said surface means and said additional surface means on said upper and lower rings to removably retain said upper and lower cone segments on each of said upper and lower rings, respectively;

means to removably secure said upper and lower cone segments in predetermined positions on each of said upper and lower rings, respectively;

an annular sleeve on said body longitudinally spaced from said rings;

longitudinally extending upper slip arms secured with said sleeve, said upper slip arms having one end extending longitudinally beyond said sleeve toward said upper ring;

longitudinally extending lower slip arms secured with said sleeve, said lower slip arms having one end extending longitudinally beyond said sleeve toward said lower ring;

upper slip segments secured to said one end of said upper slip arms and co-engageable with said upper cone segments on said upper ring for engaging said upper slip segments with the tubular member to secure the liner with the tubular member;

lower slip segments secured to said one end of said lower slip arms and co-engageable with lower said cone segments on said lower ring for engaging said lower slip segments with the tubular member to secure the liner with the tubular member;

means response to hydraulic pressure for effecting relative movement between said body and said sleeve, upper and lower slip arms and their respective upper and lower slip segments longitudinally relative to said body to engage an upper slip segment with an upper cone segment and a lower slip segment with a lower cone segment whereby said upper and lower slip segments are urged outwardly of said body to engage the tubular member;

means to align said upper and lower slip segments and upper and lower cone segments, respectively, for engagement, said means including:

at least one lug on said body and projecting therefrom;

recess means on said sleeve for receiving said lug therein to limit upward movement of said sleeve and align said upper and lower slip segments with said upper and lower cone segments, respectively, for co-engagement when said sleeve is moved longitudinally relative to said body;

means to releasably restrain said sleeve against longitudinal movement which would co-engage said upper and lower slip segments with their respective upper and lower cone segments and urge said upper and lower slip segments outwardly and into engagement with the tubular member as the liner hanger is being lowered to position in the well bore; and said means to restrain including frangible means securing said sleeve to said body.

5. The liner hanger of claim 4 wherein:

said sleeve is received in a longitudinal, annular chamber formed on said body;

piston means in said chamber for moving said sleeve longitudinally in the chamber; and port means in said body for communicating the operating string with said piston for moving said piston and said sleeve longitudinally in the chamber to engage said upper and lower slip segments with said upper and lower cone segments, respectively.

6. In a liner hanger which may be actuated mechanically for supporting a liner lowered on an operating string to position in a tubular member in a well bore including:

a longitudinally extending tubular body;

upper and lower longitudinally spaced annular rings on said body;

upper and lower cone segments for removably fitting on said upper and lower rings;

said upper and lower cone segments having longitudinally extending edges;

surface means on each of said upper and lower rings to enable said upper and lower cone segments to be removably positioned thereon;

additional surface means on each of said upper and lower rings;

surface means on each said upper and lower cone segments engageable with said surface means and additional surface means on said upper and lower rings to removably retain said upper and lower cone segments on each of said upper and lower rings, respectively;

means to removably secure said upper and lower cone segments in predetermined positions on each of said upper and lower rings, respectively;

an annular sleeve on said body longitudinally spaced from said rings;

longitudinally extending upper slip arms removably secured with said sleeve, said upper slip arms having one end extending longitudinally beyond said sleeve toward said upper ring;

longitudinally extending lower slip arms removably secured with said sleeve, said lower slip arms having one end extending longitudinally beyond said sleeve toward said lower ring;

upper slip segments secured to said one end of said upper slip arms and co-engageable with said upper cone segments on said upper ring for engaging said upper slip segments with the tubular member to secure the liner with the tubular member;

lower slip segments secured to said one end of said lower slip arms and co-engageable with said lower cone segments on said lower ring for engaging said lower slip segments with the tubular member to secure the liner with the tubular member;

means responsive to manipulation of the operating string for effecting relative movement between said body and said sleeve, upper and lower slip arms and their respective upper and lower slip segments longitudinally relative to said body to engage an upper slip segment with an upper cone segment and a lower slip segment with a lower cone segment whereby said upper and lower slip segments are urged outwardly of said body to engage the tubular member;

means to align said upper and lower slip segments and upper and lower cone segments, respectively, for engagement, said means including:

at least one lug on said body and projecting therefrom;

recess means on said sleeve for receiving said lug therein to align said upper and lower slip segments with said upper and lower cone segments, respectively, for co-engagement when said sleeve is moved longitudinally relative to said body; and means to releasably restrain said sleeve against longitudinal movement which would co-engage said upper and lower slip segments with their respective upper and lower cone segments and urge said upper and lower slip segments outwardly and into engagement with the tubular member as the liner hanger is being lowered to position in the well bore.

7. The liner hanger of claim 6 wherein said means to align and said means to releasably restrain includes:

at least one inverted U shaped recess means having first and second longitudinally extending, circumferentially spaced setting slots joined adjacent their upper ends to form the inverted U;

a block removably secured to said sleeve and extending across one of said setting slots intermediate its ends; and said lug on said body fitting in said setting slot adjacent said block as said liner hanger is lower to position in the well bore.

8. The liner hanger of claim 7 wherein each upper and lower cone segment on said upper and lower ring, respectively, is circumferentially offset from its respective co-engageable upper and lower slip segment by a circumferential angular arc distance approximately equal to the angular arc distance between the center lines of said setting slots when the liner hanger is assembled for lowering in the well bore.

9. The liner hanger of claim 7 wherein the circumferential angular arc distance between the center lines of the setting slots is not greater than the circumferential angular arc distance between the longitudinal edge of any lower cone segment and the adjacent longitudinal edge of any upper slip arm toward which the edge of any said lower cone segment is rotated in order to align respective upper and lower cone segments with their co-engageable upper and lower slip segments.

10. The liner hanger of claim 7 which is set by left-hand or counterclockwise rotation of said body and wherein the center longitudinal axis of each upper and lower cone segment is circumferentially offset in a clockwise direction from the center longitudinal axis of each respective co-engageable upper and lower slip segment by a circumferential angular arc distance approximately equal to the circumferential angular arc distance between the center lines of the setting slots.

11. The liner hanger of claim 8 which is set by left-hand or counterclockwise rotation of said body and wherein the center longitudinal axis of each upper and lower cone segment is circumferentially offset in a clockwise direction from the center longitudinal axis of each respective co-engageable upper and lower slip segment by a circumferential angular arc distance approximately equal to the circumferential angular arc distance between the center lines of the setting slots.

12. The liner hanger of claim 9 which is set by left-hand or counterclockwise rotation of said body and wherein the center longitudinal axis of each upper and lower cone segment is circumferentially offset in a clockwise direction from the center longitudinal axis of each respective co-engageable upper and lower slip segment by a circumferential angular arc distance approximately equal to the circumferential angular arc distance between the center lines of the setting slots.

13. The liner hanger of claim 7 which is set by left-hand or counterclockwise rotation of said body and wherein the center longitudinal axis of each upper and lower slip segment is circumferentially offset in a counterclockwise direction from the center longitudinal axis of each respective co-engageable upper and lower cone segment by a circumferential angular arc distance approximately equal to the circumferential angular arc distance between the center lines of the setting slots.

14. The liner hanger of claim 8 which is set by left-hand or counterclockwise rotation of said body and wherein the center longitudinal axis of each upper and lower slip segment is circumferentially offset in a counterclockwise direction from the center longitudinal axis of each respective co-engageable upper and lower cone segment by a circumferential angular arc distance approximately equal to the circumferential angular arc distance between the center lines of the setting slots.

15. The liner hanger of claim 9 which is set by left-hand or counterclockwise rotation of said body and wherein the center longitudinal axis of each upper and lower slip segment is circumferentially offset in a counterclockwise direction from the center longitudinal axis of each respective co-engageable upper and lower cone segment by a circumferential angular arc distance approximately equal to the circumferential angular arc distance between the center lines of the setting slots.

16. The liner hanger of claim 7 which is set by right-hand or clockwise rotation of said body and wherein the center longitudinal axis of each upper and lower cone segment is circumferentially offset in a counterclockwise direction from the center longitudinal axis of each respective co-engageable upper and lower slip segment by a circumferential angular arc distance approximately equal to the circumferential angular arc distance between the center lines of the setting slots.

17. The liner hanger of claim 7 which is set by right-hand or clockwise rotation of said body and wherein the center longitudinal axis of each upper and lower slip segment is circumferentially offset in a clockwise direction from the center longitudinal axis of each respective co-engageable upper and lower cone segment by a circumferential angular arc distance approximately equal to the circumferential angular arc distance between the center lines of the setting slots.

18. The liner hanger of claim 8 which is set by right-hand or clockwise rotation of said body and wherein the center longitudinal axis of each upper and lower slip segment is circumferentially offset in a clockwise direction from the center longitudinal axis of each respective co-engageable upper and lower cone segment by a circumferential angular arc distance approximately equal to the circumferential angular arc distance between the center lines of the setting slots.

19. The liner hanger of claim 9 which is set by right-hand or clockwise rotation of said body and wherein the center longitudinal axis of each upper and lower slip segment is circumferentially offset in a clockwise direction from the center longitudinal axis of each respective co-engageable upper and lower cone segment by a circumferential angular arc distance approximately equal to the circumferential angular arc distance between the center lines of the setting slots.

20. The liner hanger of claim 7 wherein the center longitudinal axis of each upper and lower cone segment is circumferentially offset in a clockwise direction from the center longitudinal axis of each respective co-engageable upper and lower slip segment by a circumferential angular arc distance which is approximately equal to the circumferential angular arc distance between the center lines of the setting slots and which circumferential angular arc distance is not greater than the circumferential angular arc distance between the longitudinal edge of any lower cone segment and the adjacent longitudinal edge of any upper slip arm towards which any edge of any of said lower cone segments is rotated in order to align respective cone segments with their co-engageable slip segments.

21. The liner hanger of claim 7 wherein the center longitudinal axis of each upper and lower slip segment is circumferentially offset in a counterclockwise direction from the center longitudinal axis of each respective co-engageable upper and lower cone segment by a circumferential angular arc distance which is approximately equal to the circumferential angular arc distance between the center lines of the setting slots and which circumferential arc distance is not greater than the circumferential angular arc distance between the longitudinal edge of any lower cone segment and the adjacent longitudinal edge of any upper slip arm towards which the edge of said lower cone segment is rotated in order to align respective cone segments with their co-engageable slip segments.

22. The liner hanger of claim 7 wherein the center longitudinal axis of each upper and lower cone segment is circumferentially offset in a counterclockwise direction from the center longitudinal axis of each respective co-engageable upper and lower slip segment by a circumferential angular arc distance which is approximately equal to the circumferential angular arc distance between the center lines of the setting slots and which circumferential arc distance is not greater than the circumferential angular arc distance between the longitudinal edge of any lower cone segment and the adjacent longitudinal edge of any upper slip arm towards which the edge of any said lower cone segment is rotated in order to align respective cone segments with their co-engageable slip segments.

23. The liner hanger of claim 7 wherein the center longitudinal axis of each upper and lower slip segment is circumferentially offset in a clockwise direction from the center longitudinal axis of each respective co-engageable cone segment by a circumferential angular arc distance approximately equal to the circumferential angular arc distance between the center lines of the setting slots which circumferential arc distance is not greater than the circumferential angular arc distance between the longitudinal edge of any lower cone segment and the adjacent longitudinal edge of any slip arm towards which the edge of any said lower cone segment is rotated in order to align respective cone segments with their co-engageable slip segments.

24. In the liner hanger for lowering into a well bore on an operating string which is selectively actuated hydraulically or by left-hand rotation or right-hand rotation of the operating string to co-engage cone and slip segments for securing a liner in a tubular member, the invention including:

an integral tubular body;

an annular outer surface on said body;

longitudinally spaced annular rings having annular edges projecting outwardly from said outer annular surface; and each of said rings having surface means on said annular edges to receive and removably interlock with the cone segments.

25. A method of forming a liner hanger body for use with a liner hanger that may be selectively actuated hydraulically, or by left-hand rotation or by right-hand rotation of the operating string to co-engage cone segments and slip segments for securing a liner to a tubular member in the well bore, comprising the steps of:

forming an integral tubular body having an annular surface with longitudinally spaced annular rings thereon;

forming annular edges on said rings projecting from said annular surface;

providing a groove extending laterally across each of said cone segments; and providing surface means on the annular edges of said rings to enable each of the cone segments to be positioned and removably interlocked with each of said rings.

26. The method of claim 25 including the step of forming sleeve means for telescopically fitting on said hanger body in longitudinal spaced relation to said rings.

27. The method of claim 26 including the steps of forming longitudinally extending slot means in said sleeve means and forming lug means on said body for engaging within said slot means.

28. The method of claim 26 including the steps of forming a pair of circumferentially spaced longitudinally extending slot means in said sleeve means and a pair of lug means with at least one lug means fitting in each of said longitudinally extending slot means.

29. The method of claim 26 including the step of forming at least one U-shaped slot means in said sleeve means and forming at least one lug means for fitting said at least one U-shaped slot means.

* * * * *